US006232541B1

(12) United States Patent
Kumagai

(10) Patent No.: US 6,232,541 B1
(45) Date of Patent: May 15, 2001

(54) DATA SENDING APPARATUS AND DATA RECEIVING APPARATUS COMMUNICATING DATA STORAGE CONTROL COMMAND IN MIDI PROTOCOL, AND METHOD THEREFOR

(75) Inventor: Tomoyuki Kumagai, Hamamatsu (JP)

(73) Assignee: Yamaha Corporation (JP)

( * ) Notice: Subject to any disclaimer, the term of this patent is extended or adjusted under 35 U.S.C. 154(b) by 0 days.

(21) Appl. No.: 09/604,840

(22) Filed: Jun. 27, 2000

(30) Foreign Application Priority Data

Jun. 30, 1999 (JP) ..... 11-186048

(51) Int. Cl.[7] ..... G10H 7/00

(52) U.S. Cl. ..... 84/645

(58) Field of Search ..... 84/645

(56) References Cited

PUBLICATIONS

"MIDI 1.0 Standards for Pratical Usage", 1st edition, Issued Mar. 20, 1998, pp. 153–162 from "MIDI Bible II".

*Primary Examiner*—Stanley J. Witkowski
(74) *Attorney, Agent, or Firm*—Rossi & Associates

(57) ABSTRACT

A personal computer having a MIDI interface and an electronic musical instrument having a MIDI interface are connected with each other by means of a sending and a receiving MIDI cable. The personal computer stores music performance data and provides control commands for managing the data storing operation in the electronic musical instrument in its local data protocol, and converts such data and commands both to MIDI exclusive data according to the MIDI protocol to send to the electronic musical instrument via the MIDI cable. The electronic musical instrument receives the MIDI exclusive data carrying such data and commands, and converts the received MIDI exclusive data back to the performance data and the control commands in the original local protocol such as DOS format to control the data storing operation in the electronic musical instrument accordingly. Thus, the personal computer can remotely manage the data storing operation in the electronic musical instrument.

31 Claims, 10 Drawing Sheets

EMI 35
21
28
31
TO HOST
32
MIDI IN
33
MIDI OUT
34
MIDI THRU
Tone Color Selection Controls
Display
22
Tone effect Selection Controls
SW1
SW2
SWn
25 Mode Slct Controls
20
Auto Perfm & Auto Accomp Controls
23
26
Ten-Key Pad
27
Cursor Keys
Musical Keyboard 10
Tone Trns Ctrl
24

Fig. 3 EMI

PC 66
67
68
73a
73b
73
TO HOST
MIDI
Communication Interface
72
Display Control Circuit
71
Control Switch Circuit
70
Bus
Drive Unit
65
Internal Storage Device
77
CPU
74
ROM
75
RAM
76

*Fig. 5* File Designation
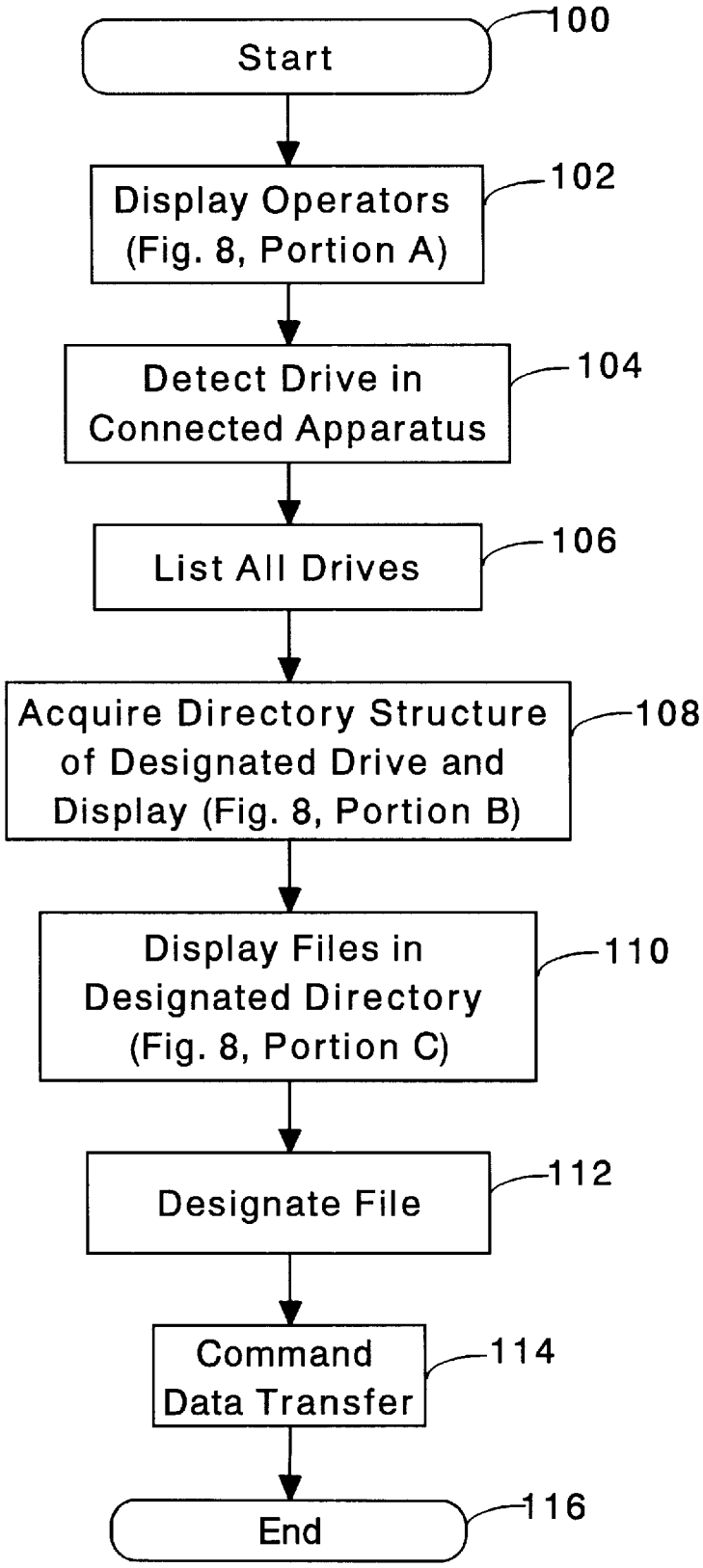

Fig. 6 Data Sending
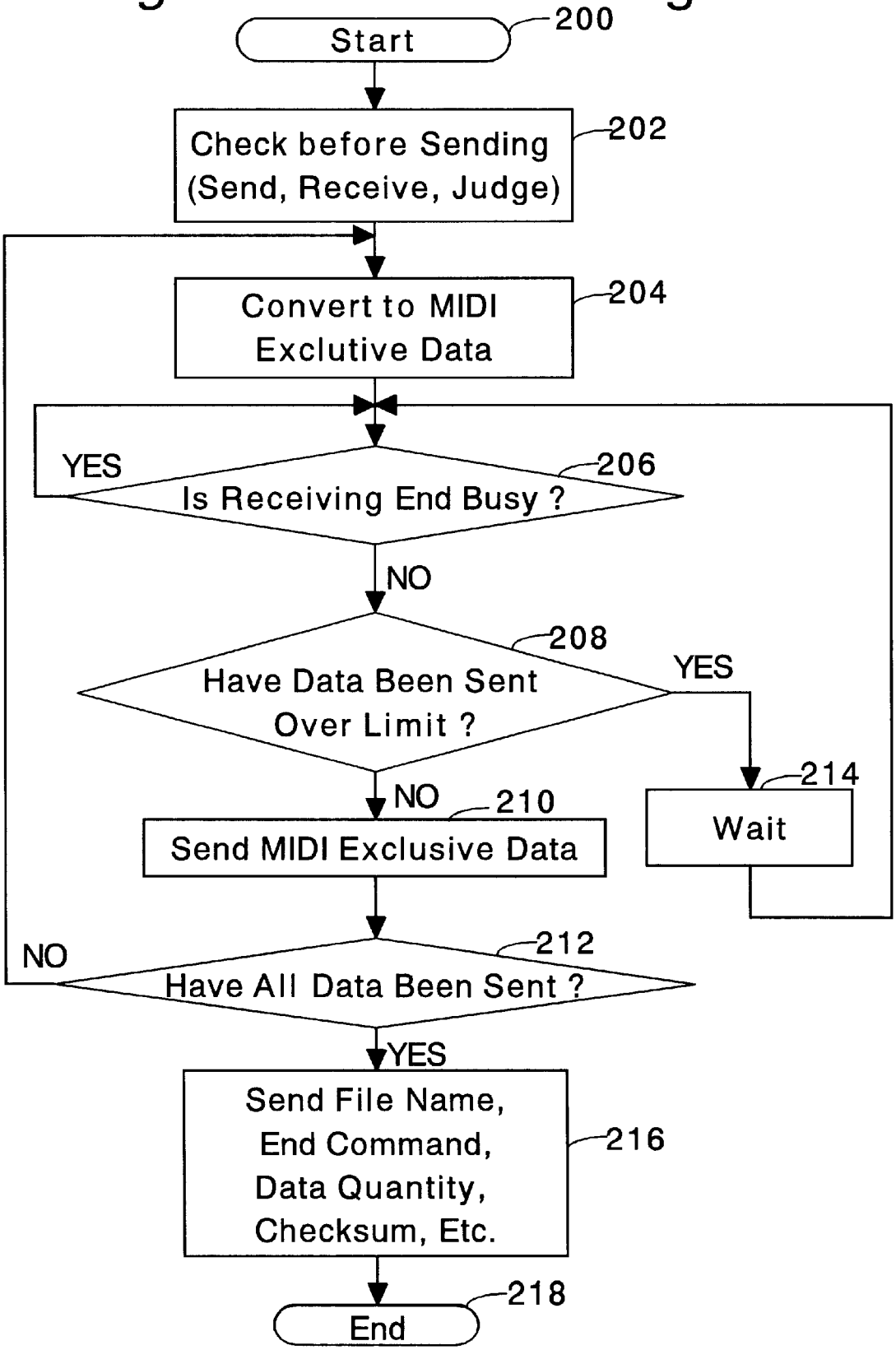

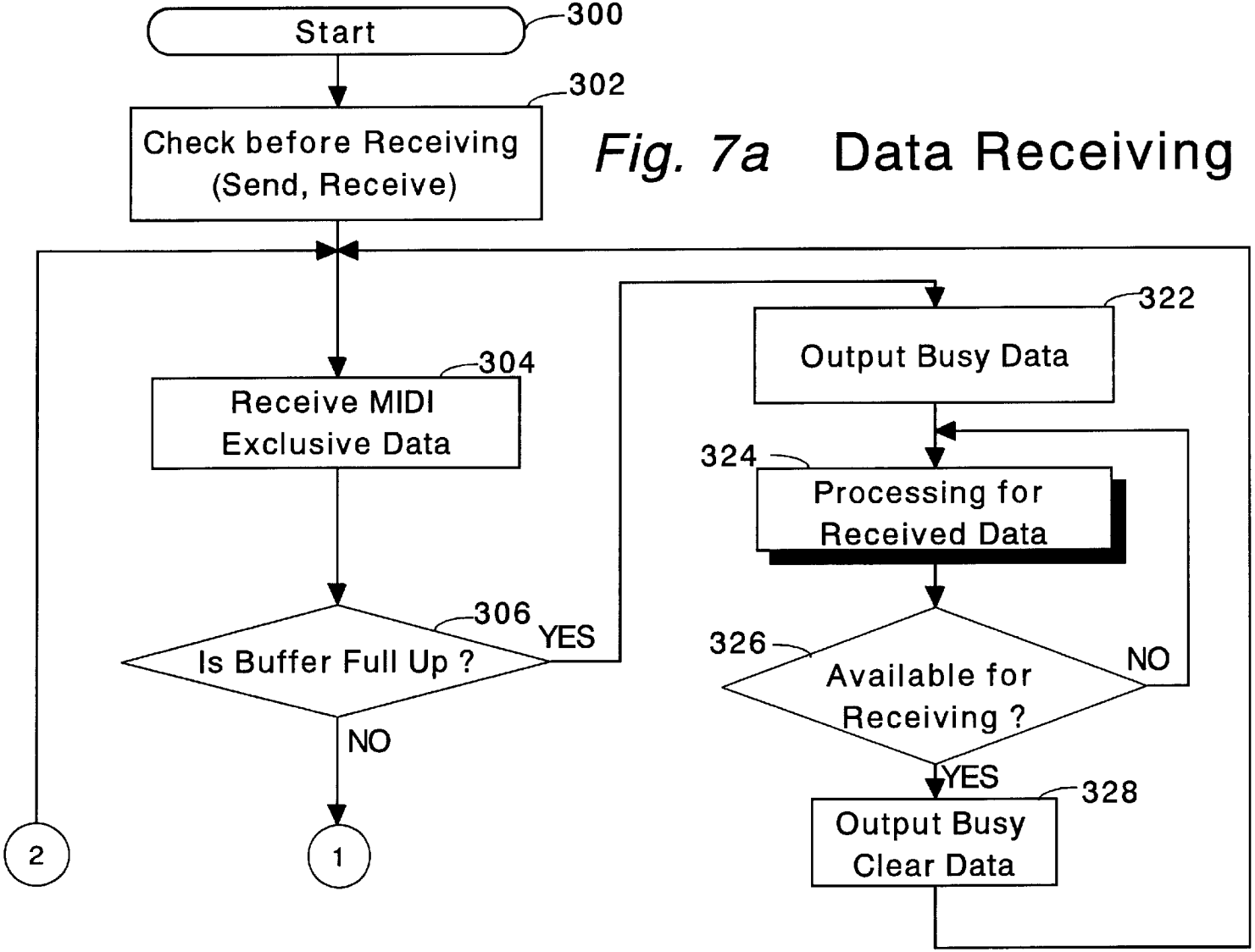
*Fig. 7a* Data Receiving (1)

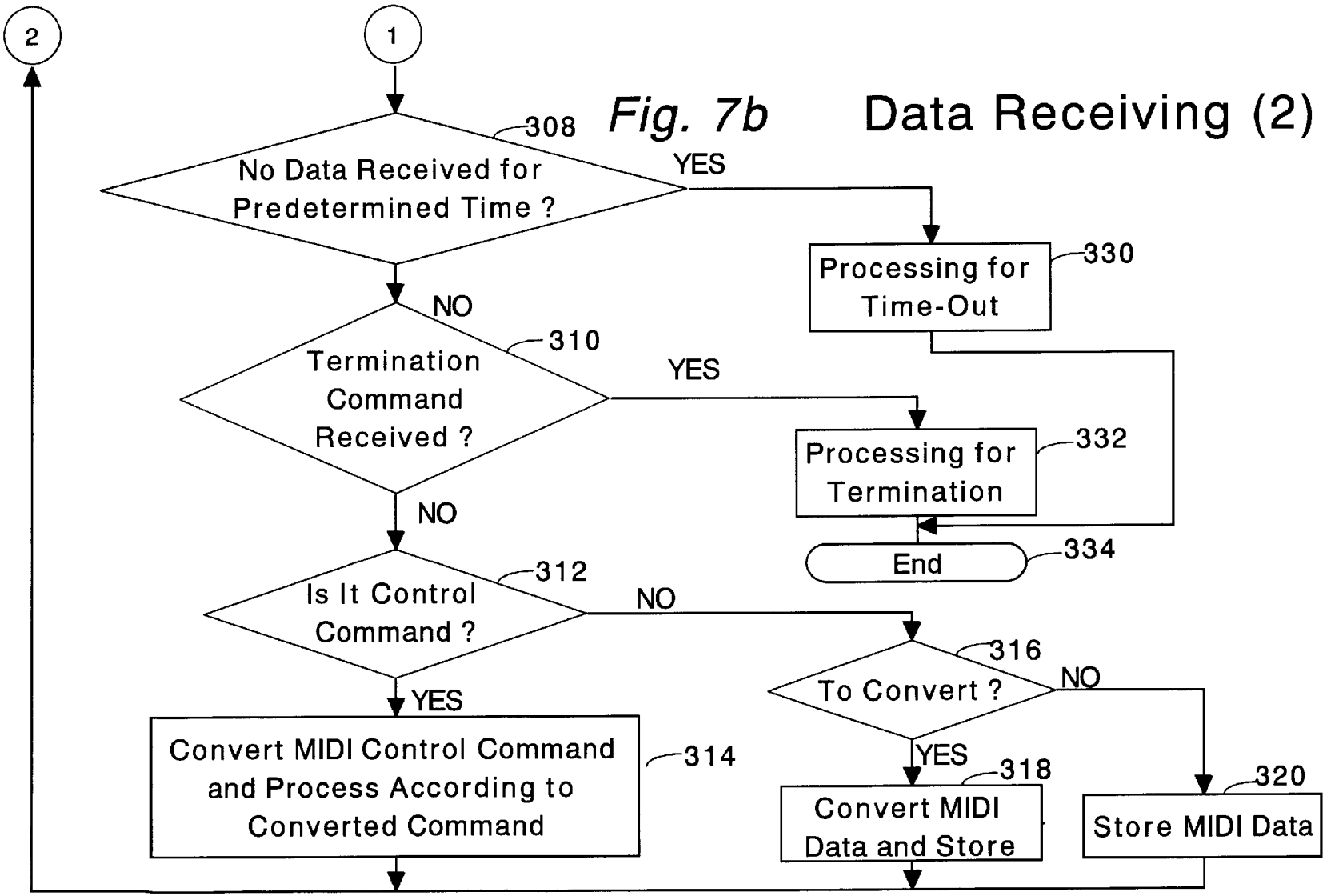
Fig. 7b Data Receiving (2)

*Fig. 8* Display Screen
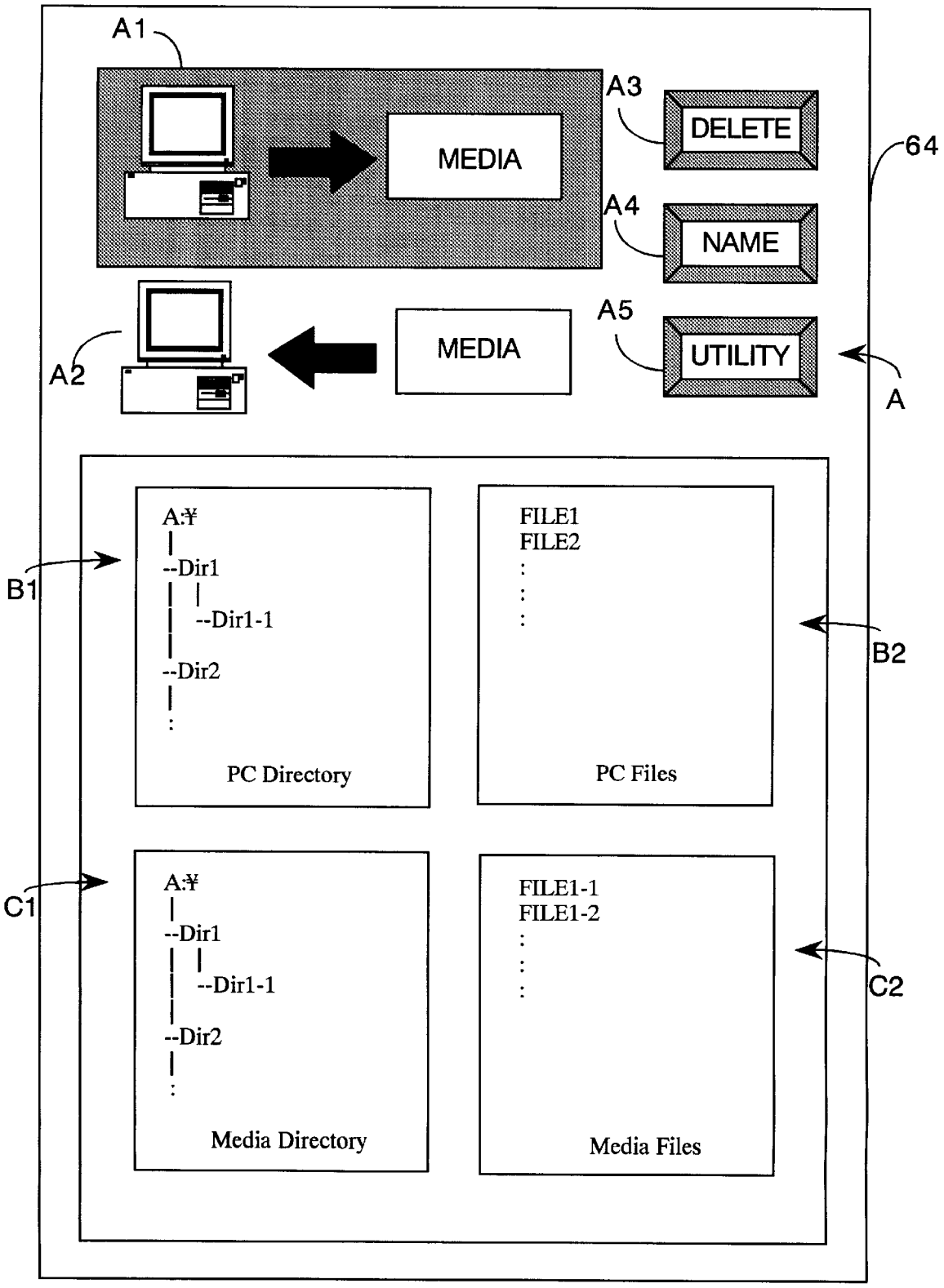

*Fig. 9a* Control Command

F0 43 10 4C 7F dr cn z1 • • • F7

Disk Command Address — Drive ID — Control Command — Tail Code cn (Command Number)

ex) 0 : Format

1 : Information

2 : Disk Status Request

⋮ z1 (Detail)

ex) z1 = 0 Disk Capacity Request z1 = 1 Disk Used Space Request z1 = 2 Disk Free Space Request

⋮

*Fig. 9b* Data

F0 43 10 4C 7E d1 d2 • • • F7

Data Transmission Address — Data — Tail Code

DATA SENDING APPARATUS AND DATA RECEIVING APPARATUS COMMUNICATING DATA STORAGE CONTROL COMMAND IN MIDI PROTOCOL, AND METHOD THEREFOR

RELATED APPLICATION

This application claims priority from Japanese Patent Application No. 11-186048, filed Jun. 30, 1999, the contents of which are incorporated hereinto by this reference.

BACKGROUND OF THE INVENTION

1. Field of the Invention

The present invention relates to an apparatus and a method for transmitting data in the MIDI protocol, and more particularly to a data sending apparatus and method and a data receiving apparatus and method in which contents data are converted to the MIDI format at the sending end and from the MIDI format at the receiving end for the data transmission in the MIDI protocol, and in which control commands for managing the data storing operation in the receiving end are further transmitted from the sending end in the MIDI protocol. The present invention also relates to a computer readable medium containing a computer program to configure and operate the above apparatuses and methods.

2. Description of the Prior Art

There have conventionally been known in the art various electronic musical apparatuses in a broad sense such as a keyboard apparatus which outputs musical performance data representing progression of tones according to manipulations of the keys and the controls in the keyboard apparatus, a tone generator apparatus which receives such musical performance data and generates and outputs musical tone signals according to the received performance data, a sequencer which automatically reads out stored musical performance data in a sequence with respect to time progression and generates and outputs tone signals according to the read-out musical performance data or outputs the read-out musical performance data per se, a data filer which receives such musical performance data and records and manages such data, and an electronic musical instrument including a keyboard and a tone generator, among which musical performance data are transmitted according to the MIDI protocol via MIDI interface circuits included in the respective electronic musical apparatuses. There have recently been introduced personal computers which incorporate MIDI interfaces, and generate, edit or record musical performance data therein and transmit such musical performance data to other electronic musical apparatuses using the MIDI format.

However, in the above-mentioned transmission of musical performance data according to the MIDI protocol, various control commands are not transmitted together with the performance contents data representing progression of tones, but only Ack/Nak messages are transmitted at the sending end and the receiving end to indicate that the data have been sent or not and that the data have been received or not, in which such Ack/Nak transmission is made per transmission of a prescribed small size (e.g. 256 bytes) of musical performance data. This causes a considerable amount of overhead and requires much time for transmitting musical performance data, which is disadvantageous for transmitting a large amount of musical performance data, especially in the case of transmitting waveform sample data. Further, in the case of transmitting the waveform sample data, the waveform sample data are transmitted as part of the musical performance data, and therefore the waveform sample data received in the receiving apparatus will be stored in a particular memory area within a tone generator or else which is unique to the receiving apparatus. Thus according to the conventional sending apparatus and receiving apparatus having a MIDI interface circuit, the storage area for the musical performance data cannot be arbitrarily designated in the receiving apparatus from the control of the sending end.

SUMMARY OF THE INVENTION

It is, therefore, a primary object of the present invention to solve the above-mentioned drawbacks involved in such conventional apparatuses or methods of sending or receiving musical performance data in the MIDI format and to provide an improved data sending apparatus and method and an improved data receiving apparatus and method which enable transmission of the data including musical performance data and control commands which may not follow the MIDI protocol and which data sending apparatus can control the data storing operations in the data receiving apparatus, for example, by detecting available storage devices (HDD, FDD, etc.), requesting directory or file information, and designating the storing area. It is also an object of the present invention to provide a computer readable storage medium containing a program executable by a computer to configure such a data sending apparatus and a data receiving apparatus as mentioned above and to perform such a data sending method and a data receiving method as mentioned above.

In order to accomplish the object of the present invention, the invention provides a data sending apparatus comprising: a first data storage device which stores contents data such as musical performance data in a non-MIDI protocol; a MIDI interface for sending out data according to the MIDI protocol to a data receiving apparatus having a second data storage device; a data read-out device which reads out the contents data from the first data storage device; a to-MIDI data converter which converts the read-out contents data in the non-MIDI protocol to data in the MIDI protocol; a data output device which outputs the converted contents data in the MIDI protocol through the MIDI interface for sending out; a control command generator which generates control commands in the MIDI protocol for controlling data storing operations of the second data storage device in the data receiving apparatus; and a command output device which outputs the control commands in the MIDI protocol through the MIDI interface for sending out.

According to the above mentioned structure of a data sending apparatus, the data transmission can be conducted efficiently without increasing overhead and further the data which are not in the MIDI protocol can be transmitted according to the MIDI protocol. Further, according to the present invention, the sending end can control the storing operations in the receiving end such as by designating the storing areas for the data in the storage device in the receiving apparatus. This increases system versatility in handling data transmission according to the MIDI protocol, and greatly improves the conveniences of the apparatuses incorporating the data transmitting devices according to the present invention.

The present invention further provides a data receiving apparatus comprising: a data storage device for storing contents data such as musical performance data in a non-MIDI protocol; a MIDI interface for receiving data according to the MIDI protocol from a sending apparatus, the received data containing contents data for being stored in the data storage device and control commands for controlling data storing operations of the data storage device; a from-MIDI data converter which converts the contents data in the received data under the MIDI protocol to contents data in the non-MIDI protocol; and a storage control device which controls data storing operations of the storage device to store the converted contents data in the non-MIDI protocol based on the control commands contained in the received data in the MIDI protocol.

According to the above mentioned structure of a data receiving apparatus, the data reception can be conducted efficiently without increasing overhead and further the data which have been converted into the MIDI protocol for the transmission purpose can be reconverted back into the original non-MIDI protocol for the local storage in the receiving apparatus. Further, according to the present invention, the storing operations such as designation of the storing areas in the receiving end can be controlled from the sending end by means of the transmitted control commands in the MIDI protocol. This increases system versatility in handling data transmission according to the MIDI protocol, and greatly improves the conveniences of the apparatuses incorporating the data receiving devices according to the present invention.

As will be apparent from the above description, a combination of the data sending apparatus and the data receiving apparatus will constitute a data communication system according to the spirit of the present invention.

The present invention further provides a storage medium for use in an apparatus for sending data to an apparatus for receiving data, the apparatus for sending including a first data storage device which stores contents data in a non-MIDI protocol and a MIDI interface for sending out data according to the MIDI protocol, the apparatus for receiving including a second storage device, both the apparatuses being of a data processing type comprising a computer, the medium containing a program that is executable by the computer, the program comprising: a module for reading out the contents data from the first data storage device; a module for converting the read-out contents data in the non-MIDI protocol to data in the MIDI protocol; a module for outputting the converted contents data in the MIDI protocol through the MIDI interface for sending out; a module for generating control commands in the MIDI protocol for controlling data storing operations of the second data storage device in the data receiving apparatus; and a module for outputting the control commands in the MIDI protocol through the MIDI interface for sending out.

The present invention further provides a storage medium for use in an apparatus for receiving data from an apparatus for sending data, the apparatus for receiving including a data storage device for storing contents data in a non-MIDI protocol and a MIDI interface for receiving data according to the MIDI protocol from the sending apparatus, both the apparatuses being of a data processing type comprising a computer, the medium containing a program that is executable by the computer, the program comprising: a module for recognizing the received data containing contents data for being stored in the data storage device and control commands for controlling data storing operations of the data storage device, a module for converting the contents data in the received data in the MIDI protocol to contents data in the non-MIDI protocol; and a module for controlling data storing operations of the storage device to store the converted contents data in the non-MIDI protocol based on the control commands in the received data in the MIDI protocol.

As will be apparent from the above description, the computer programs are useful for realizing a data sending apparatus and a data receiving apparatus within the spirit of the present invention by installing such programs in a data sending or receiving apparatus incorporating a computer, a storage device and a MIDI interface so that data in a non-MIDI protocol can be handled or processed to communicate with other MIDI-protocoled apparatuses. This greatly improves the utility of an apparatus equipped with a MIDI interface.

As will be understood from the above description about a data sending apparatus, a data receiving apparatus and a storage medium containing a computer program, a sequence of steps each performing the operational function of each of the structural element devices of the data sending apparatus and the data receiving apparatus or of the structural modules of the computer program will constitute an inventive method for sending and receiving data according to the spirit of the present invention.

Further as will be apparent from the description herein later, some of the structural element devices of the present invention are configured by computer sub-systems performing the assigned functions according to the associated programs. They may of course be hardware structured discrete devices performing the same functions.

The present invention may take form in various components and arrangement of components including hardware and software, and in various steps and arrangement of steps. The drawings are only for purposes of illustrating a preferred embodiment and processes, and are not to be construed as limiting the invention.

BRIEF DESCRIPTION OF THE DRAWINGS

For a better understanding of the present invention, and to show how the same may be practiced and will work, reference will now be made, by way of example, to the accompanying drawings, in which:

FIG. 5 is a flow chart showing an example of a file designation routine which constitutes a part of a data transmission control program according to the present invention;

FIG. 6 is a flow chart showing an example of a data sending routine which constitutes a part of the data transmission control program;

FIGS. 7*a* and 7*b* are, in combination, a flow chart showing an example of a data receiving routine which constitutes a part of the data transmission control program;

FIG. 8 is a picture of a display screen as exhibited during the file designation routine of FIG. 5;

FIG. 9*a* is a chart showing an example of a data format of MIDI exclusive data concerning a control command; and FIG. 9*b* is a chart showing an example of a data format of MIDI exclusive data concerning contents data.

DESCRIPTION OF THE PREFERRED EMBODIMENTS

Figure 1:
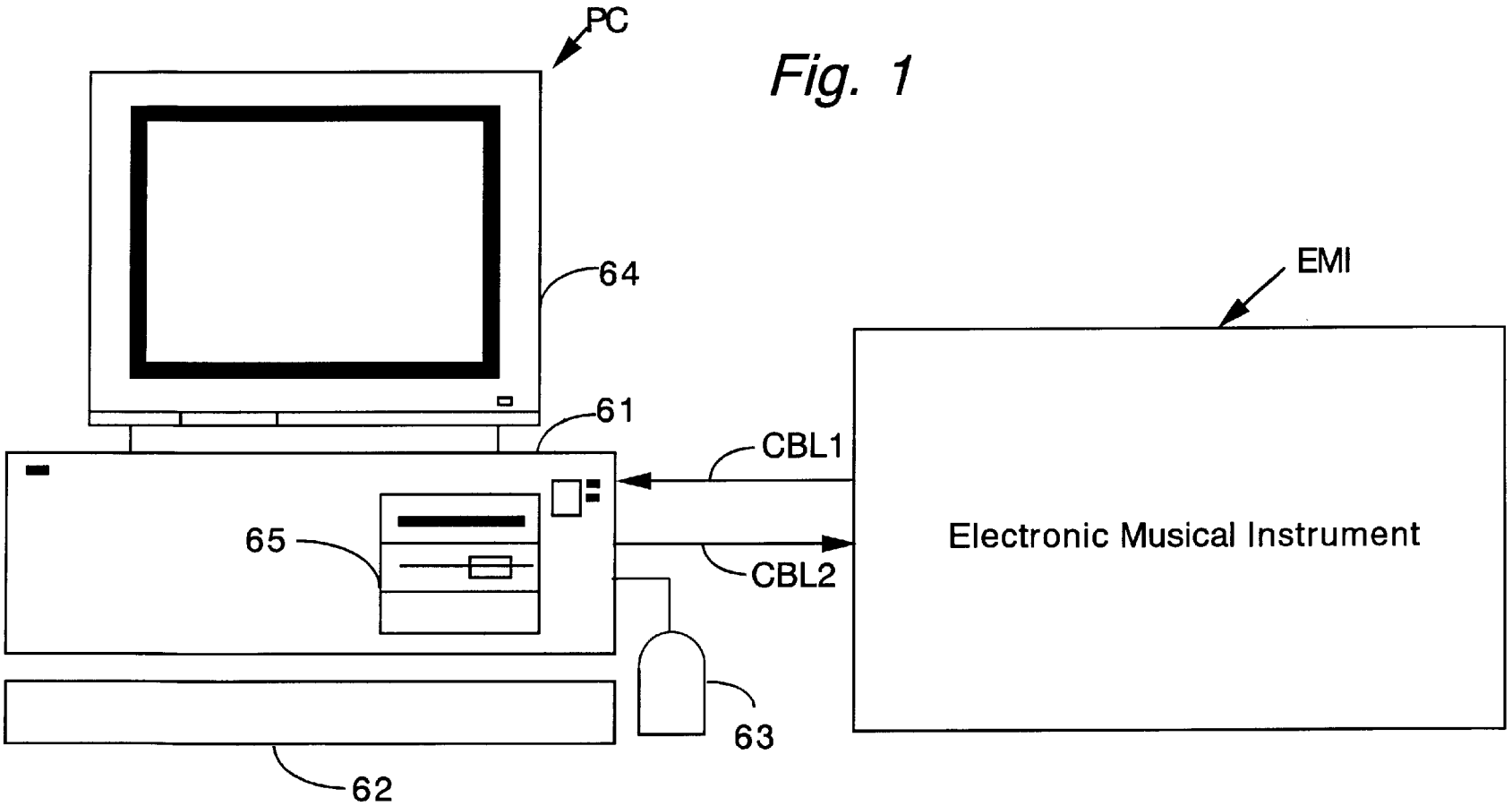
FIG. 1 is a connection diagram showing a general configuration between a personal computer and an electronic musical instrument as an embodiment of a data sending apparatus and a data receiving apparatus according to the present invention.

FIG. 1 shows a general configuration of a system according to the present invention including a personal computer PC as an example of a data sending apparatus and an electronic musical instrument EMI as an example of a data receiving apparatus, which are connected to each other by means of a pair of MIDI cables CBL1 and CBL2.

Figure 2:
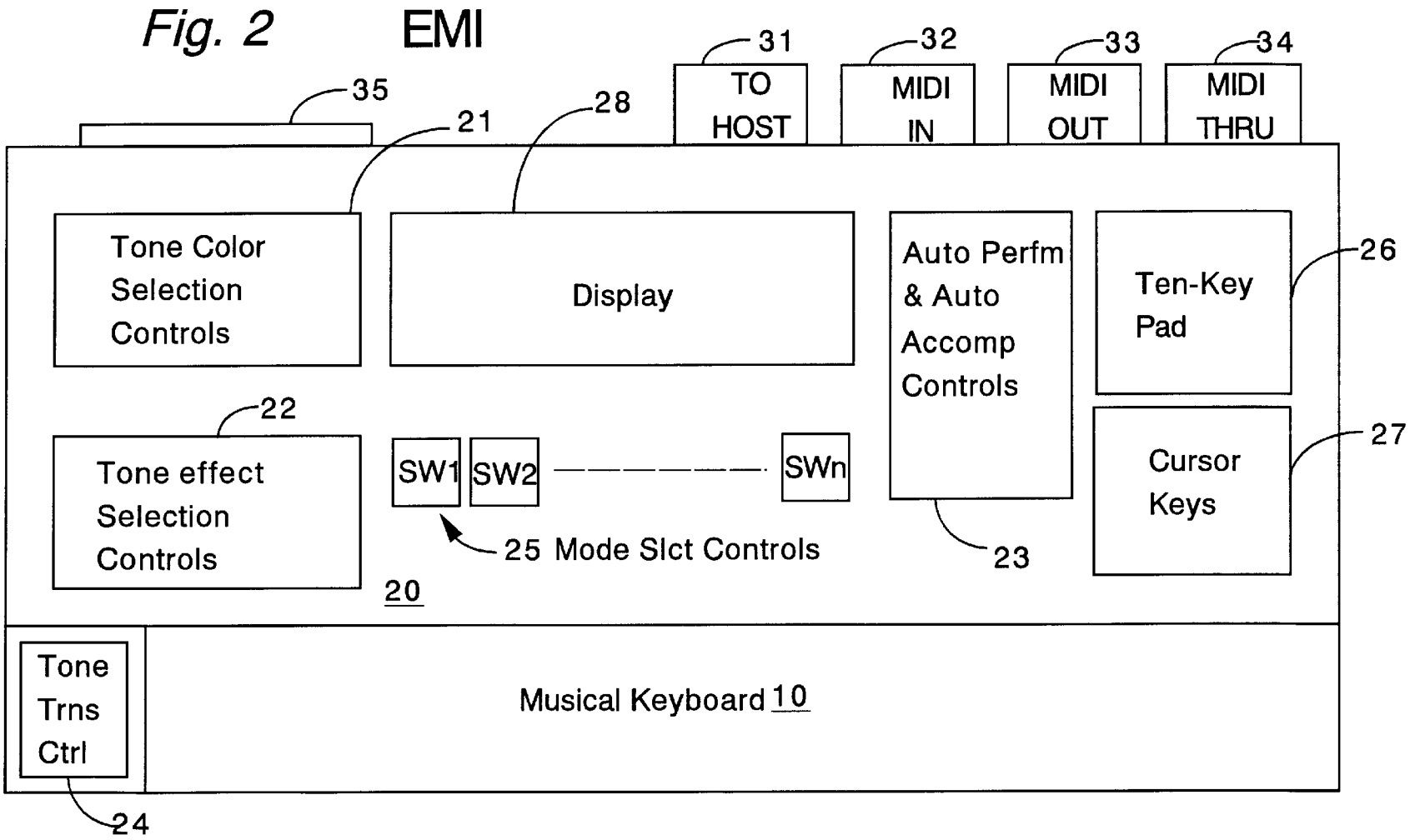
FIG. 2 is a general plan view of an example of the electronic musical instrument shown in FIG. 1.

As shown in the plan view of FIG. 2, the electronic musical instrument EMI includes a musical keyboard 10 and a control panel 20. The keyboard 10 includes a plurality of playing keys for a musical performance, each designating a note pitch and commanding the generation of a tone signal having the designated note pitch. The control panel 20 includes tone color selection controls 21, tone effect selection controls 22, automatic performance and automatic accompaniment controls 23, tone transient controls 24, mode selection controls, ten-key pad controls 26, cursor control keys 27 and a display screen 28. The tone color selection controls 21 are to select the tone colors or timbres for the tone signals to be generated. The effect selection controls 22 are to select the effects to be imparted to the generated tone signals. The automatic performance and automatic accompaniment controls 23 are to control the generation of the tone signals for an automatic performance and an automatic accompaniment. The tone transient controls 24 are provided in the form of a manipulating wheel or the like for controlling transient variation of the tone elements (i.e. tone pitch, tone color, tone intensity) of the generated tone signals according to the player's manipulation. The mode selection controls 25 are to select the operation modes of the electronic musical instrument EMI. The ten-key pad controls 26 are for inputting numeric characters and other symbols (characters) and for deciding or fixing the inputted characters and cursor pointing (e.g. files, commands). The cursor control keys 27 are to move the cursor in the display screen 28. The display screen 28 are made, for example, of a liquid crystal display panel for exhibiting characters for indication and selection.

The electronic musical instrument EMI has on its back panel a to-host terminal 31, a MIDI-in terminal 32, a MIDI-out terminal 33, a MIDI-thru terminal 34 and a drive unit (inlet) 35. The to-host terminal 31 is for the connection of a cable to transmit and receive data according to the to-host protocol. The MIDI-in terminal 32 is for the connection of a cable to receive data according to the MIDI protocol. The MIDI-out terminal 33 is for the connection of a cable to send out data according to the MIDI protocol. The MIDI thru terminal 34 is for the connection of a cable to relay the data received at the MIDI-in terminal 32 without change. The MIDI protocol is a common communication protocol for sending or receiving data in one-way fashion and is widely employed for communicating musical data including tone data and control commands between digital musical apparatuses including electronic musical instruments. The drive unit 35 is adapted for driving a compact disk, a flexible disk, a memory card or the like external storage media to read out data from and to write in data to such a storage medium.

Figure 3:
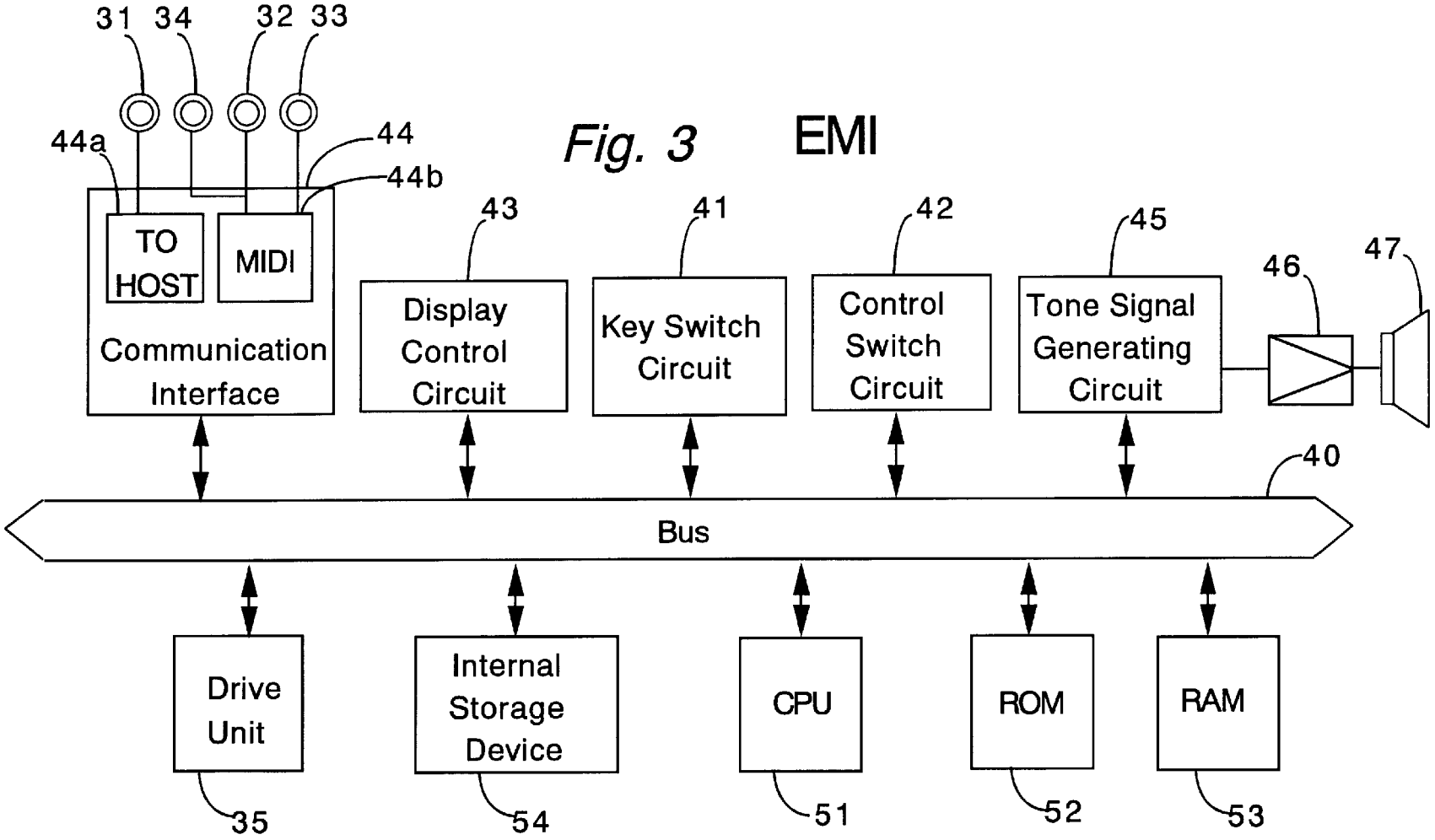
FIG. 3 is a block diagram showing an example of an internal circuit structure of the electronic musical instrument.

FIG. 3 shows a block diagram of an example of an internal circuit structure of the electronic musical instrument EMI. To a bus 40 are connected a key switch circuit 41, a control switch circuit 42, a display control circuit 43 a communication interface circuit 44 and a tone signal generating circuit 45. The key switch circuit 41 includes a plurality of key switches, each corresponding to each of the playing keys on the musical keyboard 10 and being on/off-actuated according to the depression and release of each key, thereby detecting the actuation of the keys. The control switch circuit 42 includes a plurality of on/off switches, variable resisters, etc., each corresponding to each of the controls in the respective control groups 21–27 to detect the actuation of the corresponding controls. The display control circuit 43 is to control the exhibition state of the display screen 28. The communication interface circuit 44 includes a to-host interface sub-circuit 44*a* which is connected to the to-host terminal 31, and a MIDI interface sub-circuit 44*b* which is connected to the MIDI-in terminal 32 and the MIDI-out terminal 33. The MIDI-thru terminal 34 is directly connected to the MIDI-in terminal 32 so that the data inputted to the MIDI-in terminal 32 are outputted from the MIDI-thru terminal 34 without change. The to-host interface circuit 44*a* includes a buffer memory and inputs and outputs data and commands according to the to-host protocol, while the MIDI interface circuit 44*b* also includes a buffer memory and inputs and outputs data and commands according to the MIDI protocol. The tone signal generating circuit 45 forms tone signals according to the key codes KC, the key-on signals KON, the key-off signals KOF and various tone property parameters supplied via the bus 40, and outputs the formed tone signals to an amplifier 46 and then to a loudspeaker 47 to emit audible musical sounds in the air.

To the bus 40 are also connected a CPU 51, a ROM 52 and a RAM 53 collectively constituting a microcomputer for controlling the electronic musical instrument EMI, and also an internal storage device 54 and drive units 35. The CPU 51 executes various programs to manage the transmission of data to and from external apparatuses and to manage the generation of musical tone signals. The ROM 52 and the RAM 53 are to store the programs and the data. The internal storage device 54 includes a hard disk and a drive unit therefor or the like to serve as a mass storage device.

As shown in FIG. 1, the personal computer apparatus PC are of a general type including a main system unit 61, input devices such as a keyboard 62 and a mouse 63, and a display unit 64. There is a drive unit 61 in the front panel of the main system unit 61 (shown in FIG. 1), and there are a to-host terminal 66, a MIDI-in terminal 67 and MIDI-out terminal 68 (shown in FIG. 4) in the back panel of the main system unit 61, just like the to-host terminal 31, the MIDI-in terminal 32 and the MIDI-out terminal 33 on the electronic musical instrument EMI. The drive unit 65 is adapted to a compact disk, a flexible disk or the like as external storage media and is to read out and write in programs and data to and from such storage media.

Figure 4:
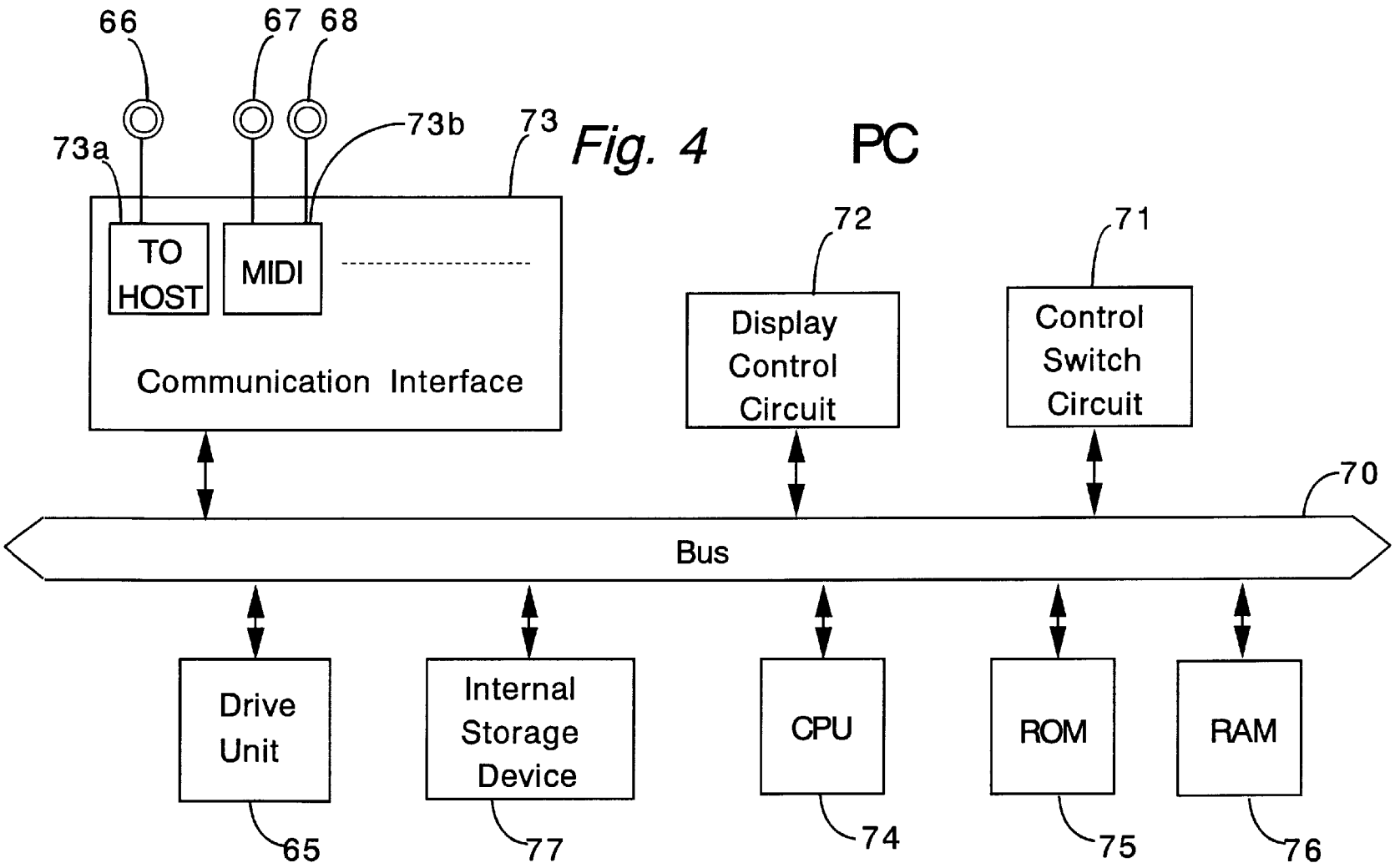
FIG. 4 is a block diagram showing an example of an internal circuit structure of the personal computer shown in FIG. 1.

FIG. 4 shows a block diagram of an example of the internal circuit structure in the main system unit 61 of the personal computer PC. To a bus 70 are connected a control switch circuit 71, a display control circuit 72 and a communication interface circuit 73. The control switch circuit 71 includes switches corresponding to the keyboard 62 and the mouse 63 and outputs signals according to the manipulation of the keyboard 62 and the mouse 63. The display control circuit 72 is to control the screen pictures and conditions of the display unit 64. The communication interface circuit 73 includes interface sub-circuits corresponding to the respective input and output terminals such as a to-host interface sub-circuit 73*a* which is connected to a to-host terminal 66 and a MIDI interface sub-circuit 73*b* which is connected to a MIDI-in terminal 67 and a MIDI-out terminal 68. The to-host interface sub-circuit 73*a* and the MIDI interface sub-circuit 73*b* are similarly structured as the case of the to-host interface sub-circuit 44*a* and the MIDI interface sub-circuit 44*b* in the electronic musical instrument EMI.

Also to the bus 70 are connected a CPU 74, a ROM 75 and a RAM 76 of a general type constituting a main system unit to control the overall operations of the personal computer apparatus PC, and are also connected an internal storage device 77 and the drive unit 65. The internal storage device 77 is constituted by a hard disk and a drive unit therefor to serve as a mass memory device.

Hereinbelow will be described how the embodiment of the present invention as structured as above operates. First, there are prepared a storage medium such as a compact disk and a flexible disk which contains an application program including a file designation routine, a data sending routine and a data receiving routine as shown in FIG. 5, FIG. 6, and FIGS. 7*a* and 7*b*, respectively, and various control command tables according to the MIDI protocol, and the application program and the MIDI control command tables are installed in the personal computer PC and in the electronic musical instrument EMI. Then, the application program and the MIDI control command tables are stored into storage devices, for example internal storage devices 54 and 77 such as a hard disk in the personal computer PC and the electronic musical instrument EMI. The personal computer PC and the electronic musical instrument EMI are connected with each other by connecting a MIDI cable CBL1 to the MIDI-out terminal 68 of the personal computer PC and to the MIDI-in terminal 32 of the electronic musical instrument EMI, and by connecting a MIDI cable CBL2 to the MIDI-out terminal 33 of the electronic musical instrument EMI and to the MIDI-in terminal 67 of the personal computer PC.

An explanation is now made about how the data are transmitted from the personal computer PC to the electronic musical instrument EMI by operating the personal computer PC. As the application program including the above-mentioned respective routines is initiated on the personal computer PC, the personal computer starts executing the file designation routine. Preferably the interconnected system may be so configured that when the application program is initiated in either of the personal computer PC and the electronic musical instrument EMI, a control command is sent to the other of the two apparatuses to automatically initiate the same application program in the other apparatus.

FIG. 5 shows the file designation routine according to the present invention. The file designation routine is to designate a file origin (data recorded area of the file to be sent) in the sending end (one of the personal computer PC and the electronic musical instrument EMI) and a file destination (data recording area of the file received) in the receiving end (the other of the personal computer PC and the electronic musical instrument EMI), and is started at a step 100 in FIG. 5. The CPU 74 then executes a step 102 to display a picture of operators on the screen of the display device 64 as shown in FIG. 8. The screen picture for operation by the user includes, as shown at portion A in FIG. 8, a picture A1 depicting the function of transmitting a file (data) from the personal computer PC to the electronic musical instrument EMI, a picture A2 depicting the function of transmitting a file (data) from the electronic musical instrument EMI to the personal computer PC, a picture A3 depicting the function of file deletion, a picture A4 depicting the function of file naming, and a picture A5 depicting the function of utility including indication about formatting, media capacity, and other information on the storage medium.

Then at a step 104, the CPU 74 outputs a control command to detect an operative or available drive unit or units in the receiving apparatus as well as to determine whether a data receivable apparatus is connected, which command is sent to the electronic musical instrument EMI according to the MIDI protocol via the MIDI interface circuit 73*b* and the cable CBL1. In the electronic musical instrument EMI, the CPU 51 executes its program to send out data according to the MIDI protocol representing the available drives in the electronic musical instrument EMI to the personal computer PC via the MIDI interface circuit 44*b* and the cable CBL2. The personal computer PC gets the data representing the available drive units and exhibits at a step 106 all the drive unit names (identification numbers) in the electronic musical instrument EMI represented by the received data as well as the drive unit names of the personal computer PC on the display screen 64. If no data representing available drives in the electronic musical instrument EMI has been received within a predetermined time period, the display screen exhibits information that there is connected no eligible apparatus for the data transmission or that the data transmission to the connected apparatus is impossible.

Under the state that the drive names are listed on the display screen 64, if the user designates particular drives respectively incorporated in the personal computer PC and the electronic musical instrument EMI, the CPU 74 let the display device 64 at a step 108 to exhibit the directory structures of the designated drives (portions B1 and C1 in FIG. 8). When a drive incorporated in the electronic musical instrument EMI is designated in the above-mentioned drive designating operation, the CPU 74 outputs a directory request command according to the MIDI protocol to request from the electronic musical instrument EMI information relating to the directory structure and the files of the designated drive unit via the MIDI interface circuit 73*b* and the cable CBL2. The electronic musical instrument EMI then sends out in response to such a request information relating to the directory structure and the files to the personal computer PC via the MIDI interface circuit 44*b* and the cable CBL2 according to the MIDI protocol. This information causes the exhibition of the directory structure on the display screen 64.

Under the state that the directory structures are exhibited on the display screen 64, if the user moves the cursor to designate a desired directory, the CPU 74 executes a step 110 to display the file names that belong to the designated directory on the screen 64 (portions B2 and C2 in FIG. 8). With respect to the files contained in the electronic musical instrument EMI, the above got information about the files are used for display.

Under the state that the file names are exhibited on the display screen 64, if the user moves the cursor to designate a desired file name, the CPU 74 conducts a step 112 to alter (e.g. reverse) the display condition of the designated file name. Thus, the file to be sent out (origin data) and the file to write in (destination area) have been selected. In selecting the destination file, the file naming function (picture A4) in the operational picture displayed by the step 102 may be used according to necessity.

As the user designates either of the figures A1 and A2 in the operational picture on the screen 64 by the cursor to designate the direction of data transmission, the CPU 51 conducts a step 114 to reverse the designated figure (A1 or A2) and command the data transfer in the direction of the designated figure. FIG. 8 shows the case in which the figure A1 is selected, i.e. the data transfer from the personal computer PC to the electronic musical instrument EMI is selected. Thereafter, a step 116 ends the file designation routine.

The designation or selection of the files and the direction of the data transmission may not necessarily be conducted by using a dedicated operational picture, but may be conducted otherwise. For example, storage media (or their drive unit names) such as a hard disk equipped in the internal storage device 54 and a flexible disk and a compact disk set in the drive unit 35 at the electronic musical instrument EMI may be handled as external storage media for the personal computer PC. For example, the internal storage device 77 at the personal computer PC may be named "drive A" and the drive unit 65 equipped with a storage medium such as a flexible disk and a compact disk at the personal computer PC may be named "drive B", while the internal storage device 54 at the electronic musical instrument EMI may be named "drive C" and the drive unit 35 equipped with a storage medium such as a flexible disk and a compact disk at the electronic musical instrument EMI may be named "drive D." The file designation may be handled among these drives A–D in the same manner as in the case of copying or moving a file between the designated drives in an ordinary computer apparatus. In such a case, the storage media in the personal computer PC may be handled as drives C and D and the storage media in the electronic musical instrument EMI may be handled as drives A and B, instead. In any case, each of the drives (storage media) should only be identified or uniquely distinguished one from the others when viewed at the personal computer PC and at the electronic musical instrument EMI.

An explanation will be now made with respect to the data on performance contents and the control commands according to the MIDI protocol as used in the above described file designation and the later described data transmission. According to the MIDI protocol, the most significant bit MSB (in the eight-bit format) of all the data except for the data represent statuses must be "0" in the binary notation, and the data are expressed in a format called "MIDI exclusive format." Hereinbelow, the contents data and the control commands which have been converted into the MIDI format will be collectively referred to as MIDI exclusive data. The MIDI exclusive data consist of an address section including a head code "F0" (in the hexadecimal notation), a data section including contents data or control commands, and a tail code "F7", in which every byte of the contents data and the control commands except for the head code and the tail code has the most significant bit of "0" in the binary notation.

FIG. 9*a* shows an example of a data format of the MIDI exclusive data concerning a control command, in which "F0 43 10 4C 7F" constitute an address section for a disk command, "dr" is a drive ID assuming a specific number, and "cn z1 . . . " constitute a control command section. Within the control command section, the byte "cn" assumes a command number such as "0" meaning "to format", "1" meaning "for information" and "2" meaning "to request the disk status." The bytes "z1" and thereafter are to indicate the details for each command identified by the command number "cn." For example, where the command number "cn" is "2" (meaning a disk status request command), "z1 . . . "="0" indicates a request for the disk capacity, "z1 . . . "="1" indicates a request for the disk used space, "z1 . . . "="2" indicates a request for the disk free space, and so forth. To exemplify a control command more specifically, a control command to request the disk free space of the drive ID of "00" assumes a data sequence of "F0 43 10 4C 7F 00 02 20", whereas a control command to notify the disk free space assumes a data sequence of "F0 43 10 4C 7F 00 01 z1", in which the portion "z1 . . . " represents an amount of the disk free space. In creating these control commands, the above-mentioned control command table is looked up at the time of sending or receiving the data. To explain the control command table more in detail, the control command table is a table widely used in many computer apparatuses and stores the respective control commands in the general disk operating system DOS controlling the disk management and the file read-out/write-in operation and the respective control commands according to the MIDI protocol in a look-up table fashion. At the time of sending the control commands, the conversion from the control commands in the general disk operating system DOS format to the control commands according to the MIDI exclusive data format takes place, whereas at the time of receiving the control commands, the reverse conversion takes place.

FIG. 9*b* shows an example of a data format of the MIDI exclusive data concerning contents data, in which "F0 43 10 4C 7F" constitute an address section for contents data, "d1 d2 . . . " constitute a contents data section representing the contents of the data to be transmitted. In the case of the data sequence of "d1 d2 . . . ", the most significant dit MSB of each byte of d1, d2, . . . must be "0" in the binary notation. Therefore, in order to transmit data not in the MIDI format, the data must be converted to data according to the MIDI protocol, namely a sequence of data of which every byte has a most significant bit of "0" in the binary notation. When the data in the MIDI format are to be brought back to the original non-MIDI format, the conversion reverse to the above description will take place.

The conversion process will be described hereunder. First, an explanation will be made with respect to the case where non-MIDI data is converted into the MIDI exclusive data. The first thing to do is to group a sequence of data of which each data unit is eight bits into groups of seven bytes (each group having seven bytes). In the case of data including data units which consists of more than eight bits, each unit which has more than eight bits is divided into sub-units of eight bits, and such sub-divided data units are grouped into groups of seven bytes. From thus made data sequence of seven-byte units, the most significant bits of the respective bytes (one bit from one byte) are extracted in the order of the sequence, and then the order of sequence of the extracted seven bits is reversed, and next a value "0" in the binary notation is added above the most significant bit of thus reversed seven-bit train to make (convert to) an eight-bit data unit. Thus obtained eight-bit data unit (i.e. one byte data unit) is referred to as MSB data piece. On the other hand, with respect to each seven-bit data unit resulted from the extraction of the MSB from each byte unit, one bit of a value "0" in the binary notation is placed above the most significant bit of the seven-bit data unit to make each eight-bit data unit (i.e. one-byte data unit) and compose a data sequence of seven bytes. Then in front of this composed data sequence of seven bytes the above obtained MSB data piece is placed to create a new eight-byte data sequence.

The above described data conversion operation will be further explained with respect to a specific example of a data sequence. Assuming one of the grouped seven-byte data sequences is "12 34 45 56 78 90 A1" in the hexadecimal notation, the most significant bits MSB of the respective bytes of these seven bytes are "0", "0", "0", "0", "0", "1" and "1", and therefore the above named MSB data piece is now "0 1 1 0 0 0 0 0". On the other hand, the seven-byte data sequence of which the most significant bit MSB of each byte has been extracted and a bit of "0" has been placed in place thereof is now "12 34 45 56 78 10 21". Thus the finally converted data sequence will be "60 12 34 45 56 78 10 21". This shows that the original seven-byte data sequence has been converted into a data sequence of eight bytes of which the most significant bit MSB of each byte is "0" in the binary notation.

Next will be described the case in which the MIDI exclusive data are converted into data of other format than the MIDI format, i.e. non-MIDI data. An eight-byte data sequence in the MIDI protocol, e.g. the above converted (obtained after conversion) MIDI exclusive data is given. From the top byte data, seven bits of binary data from the least significant bit (LSB) side are extracted. With respect to the remaining seven bytes of data sequence, the respective most significant bits MSB of the respective bytes are replaced with the respective ones of the extracted seven bits in the ascending bit order (from the lowest bit side to the highest bit side). Through this process, the original seven-byte data sequence is obtained in the reverse manner to the above manner. A specific example of this reverse conversion will be that an eight-byte data sequence of the MIDI exclusive data in the hexadecimal notation is "60 12 34 45 56 78 10 21", the top byte data is "60" in the hexadecimal notation, which is "0 1 1 0 0 0 0 0" in the binary notation, the remaining seven-byte data sequence is now "12 34 45 56 78 10 21", the extracted seven bits from the LSB side are "0", "0", "0", "0", "0", "1" and "1" as placed in the ascending bit order, and the finally obtained (by replacement of the MSB of the respective bytes) data sequence will be "12 34 45 56 78 90 A1". This proves that the data sequence which has been converted from the original data value sequence to the MIDI exclusive data value sequence has now been converted back to the original data sequence.

Now a description will be made about the case where the personal computer PC sends data to the electronic musical instrument EMI. FIG. 6 shows a flow chart of an example of a data sending routine, which constitutes another part of the data transmission control program, and FIGS. 7*a* and 7*b* show, in combination, a flow chart of an example of a data receiving routine, which constitutes still another part of the data transmission control program according to the present invention. When the transmission of data in a designated file at the personal computer PC to a particular storage area (e.g. a designated directory of a designated storage device) in the electronic musical instrument EMI is commanded by the user, the CPU 74 of the personal computer PC initiates the execution of a data sending routine at a step 200 of FIG. 6. Concurrently, the CPU 51 of the electronic musical instrument EMI initiates the execution of a data receiving routine at a step 300 of FIG. 7*a*.

Upon initiation of the data sending routine and the data receiving routine, the personal computer PC executes at a step 202 check processes for sending data, and the electronic musical instrument EMI executes at step 302 check processes for receiving the data, before sending the data through a step 204 and onward and receiving the data through a step 304 and onward, respectively.

The steps 202 and 302 include, for example, the following processes. The personal computer PC outputs a control command in the form of MIDI exclusive data requesting the free space within the capacity of the designated storage device via the cable CBL1 to the electronic musical instrument EMI. Responsive to this request, the electronic musical instrument EMI detects the capacity of the designated storage device and the used space by the stored data, calculate the free space, and send back MIDI exclusive data (a kind of control command) representing the free space amount via the cable CBL2 to the personal computer PC. The personal computer PC receives the free space information and compares the same with the amount of data to be sent to judge whether the designated storage area in the electronic musical instrument EMI is available for storing the intended data. If the judgment rules available, the personal computer PC designates a storage device and area in the electronic musical instrument EMI as the destination for the intended data sending. For the designation of the storage area, a control command in the form of MIDI exclusive data designating a directory name or the like is transmitted from the personal computer PC to the electronic musical instrument EMI via the cable CBL1. Responsive to this control command, the electronic musical instrument EMI prepares the designated storage area for writing the data to receive subsequently. If, on the other hand, the comparison proves that the data storage would be impossible in the designated storage device and area in the electronic musical instrument EMI, the personal computer PC announces to the user that the data storage will be impossible and urges the user to designate another storage area for the data to be sent.

After the above described preparatory communication of checking the availability for data transmission between the personal computer PC and the electronic musical instrument EMI at the steps 202 and 302, the CPU 74 in the personal computer PC reads out from the designated file the contents data to be sent by a predetermined amount (e.g. 256 bytes) per time and converts into MIDI exclusive data as well as the associated control command to MIDI exclusive data at a step 204. The control command may not necessarily be issued in the non-MIDI format first and be next converted into the MIDI format, but may be issued in the MIDI format originally. The gist is that the control command to be transmitted to the receiving end should be according to the MIDI protocol. Next, a step 206 judges whether the receiving end is in the busy condition. In this judgment step, the judgment is to be made whether a control command in the form of the MIDI exclusive data representing the busy state is sent from the electronic musical instrument to the personal computer PC. If there is no control command representing the busy state being transmitted from the receiving end, the step 206 judges negative (NO), and then a step 208 judges whether more than a predetermined amount (e.g. 4 kilobytes limit) of consecutive data have already been sent. This judgment is to avoid the transmission of too much data at a time to be processed in the electronic musical instrument EMI.

If the amount of data that have been sent consecutively does not exceed the predetermined limit, the step 208 judges negative (NO), and then a step 210 sends the above converted MIDI exclusive data to the electronic musical instrument EMI via the cable CBL1. Next, a step 212 judges whether all the intended data have been sent. If all the data have not yet been sent, the step 212 judges negative (NO), and the process goes back to the step 204 to repeat the steps 204 through 212 to continue to convert and send the data of the designated file successively at a rate of a predetermined amount at a time according to the MIDI protocol.

If the amount of data that have been sent consecutively reaches the predetermined limit amount during the transmission of the MIDI exclusive data, the step 208 judges affirmative (YES) to proceed the program to a step 214. The step 214 is to wait for a predetermined length of time and thereafter to return to the step 206. As long as the electronic musical instrument EMI is in its busy state, the step 206 judges affirmative (YES) and repeats the same judgment over and over again, not going forward to the step 208. When all the data in the designated file have been sent, the step 212 judges affirmative (YES) and the process proceeds to a step 216 to convert and send the file name, the transmission end command, the data quantity, the checksum, and so forth in the MIDI protocol via the cable CBL1 to the electronic musical instrument EMI. Thereafter, the data sending routine comes to an end at a step 218.

On the other hand, the electronic musical instrument EMI executes the processing from the step 304 and onward after the above preparatory checking process at the step 302. As the MIDI exclusive data are sent from the personal computer PC via the cable CBL1, the step 304 receives (recognizes the receipt through the MIDI interface) the MIDI exclusive data and stores the received data in a buffer device or circuit in the MIDI interface circuit 44*b* successively. Then the process proceeds to a step 306 to judge whether the buffer in the MIDI interface circuit 44*b* is full up or not. Subsequent to the step 306, there are further judgment steps 308 and 310 (FIG. 7*b*) in connection with the data receiving operation. The step 308 judges whether there has been no MIDI exclusive data received for more than a predetermined period of time. The step 310 judges whether a command indicating the termination of data sending is recognized in the received data signal. As long as the buffer is not full up, MIDI exclusive data are received within predetermined time intervals, and the a command indicating end of sending is not recognized, the steps 306–310 all judges negative (NO) to pass through the process to a step 312. The steps 312–320 handles data conversion, data storage and associated operations. The step 312 reads out the MIDI exclusive data in the buffer of the MIDI interface circuit 44*b* successively, and judges whether the read-out MIDI exclusive data is of a control command or not. If the read-out MIDI exclusive data relates to a control command, the step 312 judges affirmative (YES), the step 314 converts the control command in the MIDI exclusive data format to the predetermined local control command (e.g. control command in the DOS format, i.e. a non-MIDI format) of the operating system employed in the electronic musical instrument EMI, and executes the processing according to the converted command, before directing the program back to the step 304.

If the MIDI exclusive data read out from the buffer is of contents data, the step 312 judges negative (NO), the program proceeds to the step 316. The step 316 is to select whether to store the contents data portion of the MIDI exclusive data after converted into the original format or without conversion (the MIDI format per se) according to the designation by the user at the personal computer PC or at the electronic musical instrument EMI. When the designation "to convent" is selected, the step 316 judges affirmative (YES) and next the step 318 converts the data contents portion of the MIDI exclusive data into the original format data by the above method, and write the converted data into the designated storage area of the designated storage device. If the designation "not to convert" is selected, the step 316 judges negative (NO) and next the step 320 stores the data contents portion of the MIDI exclusive data itself into the designated storage area of the designated storage device.

If the buffer in the MIDI interface circuit 44*b* becomes full up while looping through the steps 312–320, the step 306 judges affirmative (YES) and the program executes the processing through steps 322–328 (FIG. 7*a*). The step 322 sends out MIDI exclusive data indicating that the electronic musical instrument EMI is in a busy state of data receiving to the personal computer PC via the cable CBL2. Upon receipt of such busy data, the personal computer PC temporarily stops (adjourns) sending the data as described before (repeating the step 208). After the step 322, the electronic musical instrument EMI conducts the steps 324 and 326 to continue processing the received data until a sufficient free space will have been established in the buffer of the MIDI interface circuit 44*b* and the electronic musical instrument EMI becomes available for receiving data. More specifically, the processing for the received data at the step 324 includes the execution of the control commands and the storage of the contents data depending on whether the received MIDI exclusive data are control commands or contents data similar to the aforementioned processing through the steps 312–320 (FIG. 7*b*). When the electronic musical instrument EMI becomes available for receiving data, the step 326 judges affirmative (YES) and the step 328 sends out MIDI exclusive data indicating that the busy state has been cleared to the personal computer PC via the cable CBL2. Then, the personal computer PC resumes the data sending operation.

If the MIDI exclusive data has not been received for more than a predetermined period of time, the step 308 judges affirmative (YES) and the process for time-out takes place at a step 330. In this time-out process, the electronic musical instrument EMI displays on the display panel 28 a message that some abnormality has occurred in data sending operation to notify the fact to the user, sends the MIDI exclusive data indicating the occurrence of abnormality to the personal computer PC via the cable CBL2, conducts necessary processes for terminating the data communication, and ends the execution of the data reception program at a step 334.

When a command of termination of sending is recognized in the received data, the step 310 judges affirmative (YES) and the program proceeds to a step 332 to conduct processing for termination of the data receiving operation. The step 332 includes the process of converting the MIDI exclusive data which is sent from the personal computer PC with the command of termination of sending and which represents the file name, the data quantity, the checksum, etc. to control commands and contents data of the predetermined data format by referring to the control command look-up table, the process of giving a file name to the data group stored in the designated storage device (area), and the process of checking whether the data transmission has been correctly done. Thereafter, the program ends the execution of the data sending routine at the step 334.

In the above described embodiment, the user designates on the personal computer PC the data file in its internal storage device 74 or in the external storage device and also designates the internal storage device 54 in the electronic musical instrument EMI or the external storage device connected thereto as the destination storage area for the data file to be sent, and the personal computer PC converts the contents data to be sent into the MIDI exclusive data and also issues the control commands in the MIDI exclusive data format and transmits to the electronic musical instrument EMI via the MIDI interface circuit 73*b* and the cable CBL1. And in the electronic musical instrument EMI, the contents data and the control commands in the MIDI exclusive data format are converted back to the non-MIDI data to control the operations in the electronic musical instrument EMI for storing the transmitted contents data. Therefore, according to the above embodiment, data transmission can be conducted efficiently without increasing overhead and transmission of non-MIDI data is made possible. As the file management on the side of an electronic musical instrument can be conducted from the personal computer side, versatility in data transmission will be enhanced, and the utility of a personal computer and an electronic musical instrument will be greatly improved.

In the above embodiment, the data sending end, i.e. the personal computer PC designates the data in the storage device of the sending side for the data to be transmitted and designates the storage device of the receiving end, i.e. the electronic musical instrument EMI for the destination storage device (storage area). Alternatively, however, the electronic musical instrument EMI, i.e. the receiving end may designate the destination storage device (storage area) and may designate the data in the personal computer for the data to be transmitted. In the latter case, the storage device (area) in the personal computer PC may be designated for the origin of data read-out using the ten-key pad controls 26, the cursor control keys 27 and the display screen 28 to designate the contents data or file to be transmitted, and also the storage device (area) in the electronic musical instrument EMI may be designated for the destination of the data storage using the same devices at the receiving end.

Further alternatively, data may be transmitted from the electronic musical instrument side to the personal computer side. Further, in such a case, the data to be transmitted (origin file) may be designated at the electronic musical instrument EMI side or may be designated at the personal computer. Also, the storage device (storage area) for storing the transmitted data may be designated at the electronic musical instrument side or may be designated at the personal computer PC side.

Although the details of message (control commands) communication between the personal computer PC and the electronic musical instrument EMI are not described in the above embodiment, when a control command indicating abnormality is sent from the one apparatus to the other apparatus, the abnormality is displayed on such sending and transmission of data may be terminated immediately, or the control command indicating the abnormality may be transmitted again so that the apparatus will wait for return from the abnormality. In the above embodiment, the control commands are not stored in the storage device and only the contents data are stored in the storage devices. However, all the MIDI exclusive data including both the control commands and the contents data may be stored in the storage device successively.

Further, in the above described embodiment, transmission of the contents data and the control commands from the personal computer PC to the electronic musical instrument EMI and transmission of the contents data and the control commands from the electronic musical instrument EMI to the personal computer PC both utilize the data transmission according to the MIDI protocol. But, the transmission protocol may not necessarily be limited to the MIDI protocol for both ways of data transmission, and the one way of the data transmission may be in the MIDI protocol and the other way of the data transmission may be in the non-MIDI protocol.

While the above embodiment includes a personal computer and an electronic musical instrument for data communication of the contents data and the control commands between the two, either of the two or both of the two may be other type of electronic musical apparatus or apparatuses such as a keyboard apparatus which outputs musical performance data representing progression of tones according to manipulations of the keys and the controls in the keyboard apparatus, a tone generator apparatus which receives musical performance data and generates and outputs musical tone signals according to the received performance data, a sequencer which automatically reads out stored musical performance data in a sequence with respect to time progression and generates and outputs tone signals according to the read-out musical performance data or outputs the read-out musical performance data per se, and a data filer which receives inputted musical performance data and records and manages such data. Namely, any apparatus or apparatuses having a MIDI interface circuit and being adapted for installing application programs and control command tables can replace the personal computer or the electronic musical instrument or both of the above embodiment.

The data may be sent to and stored in such an apparatus that is capable of receiving data according to the MIDI protocol (MIDI exclusive data) although not having the same receiving function as the above embodiment. In such an instance, the data sending apparatus may be equipped with a playback function equivalent to a sequencer and may read out the data at a predetermined time interval (corresponding to the interval data in the automatic performance) to convert to MIDI exclusive data, converting the control commands to the MIDI exclusive format according to necessity. And such MIDI exclusive data may be stored intact in the storage device of the destination apparatus just like the case of conventional music performance data transmission in the MIDI protocol. The data transmission rate (the above-mentioned predetermined time interval) may be made variable by providing a tempo control.

On the other hand, the data may be sent out from such an apparatus that is capable of sending data according to the MIDI protocol (MIDI exclusive data) although not having the same sending function as the above embodiment. In such an instance, the data receiving apparatus may be equipped with a recording function equivalent to a sequencer and may receive and record various data as in the case of receiving and recording musical performance data. In such a case, however, the sending apparatus is not capable of sending so much data in a short period of time and is not capable of recognizing the busy status, and therefore the apparatus is so set to evaluate no abnormality even though it does not receive data for more than a predetermined period of time, but to continue data sending and data receiving, and to send no control command.

Further, the present invention may be applied to data communication using to-host terminals on data processing apparatuses.

While particular embodiments of the invention have been described, it will, of course, be understood by those skilled in the art without departing from the spirit of the present invention so that the invention is not limited thereto, since modifications may be made by those skilled in the art, particularly in light of the foregoing teachings. It is therefore contemplated by the appended claims to cover any such modifications that incorporate those features of these improvements in the true spirit and scope of the invention.

What is claimed is:

1. A data sending apparatus comprising:

a first data storage device which stores contents data in a non-MIDI protocol;

a MIDI interface for sending out data according to the MIDI protocol to a data receiving apparatus, said data receiving apparatus comprising a second data storage device;

a data read-out device which reads out said contents data from said first data storage device;

a to-MIDI data converter which converts said read-out contents data in the non-MIDI protocol to data in the MIDI protocol;

a data output device which outputs said converted contents data in the MIDI protocol through said MIDI interface for sending out;

a control command generator which generates control commands in the MIDI protocol for controlling data storing operations of said second data storage device in said data receiving apparatus; and a command output device which outputs said control commands in the MIDI protocol through said MIDI interface for sending out.

2. A data sending apparatus as claimed in claim 1, wherein said control commands contain a command to designate a data storing area of said second data storage device in said data receiving apparatus for storing contents data received.

3. A data sending apparatus as claimed in claim 1, wherein said control commands contain a command to detect availability of said second data storage device in said data receiving apparatus.

4. A data sending apparatus as claimed in claim 1, wherein said control commands contain a command to request information about directories or files in said second data storage device available in said data receiving apparatus.

5. A data sending apparatus as claimed in claim 1, wherein said control commands contain a command to request information about a free space in said second data storage device available in said data receiving apparatus.

6. A data sending apparatus as claimed in claim 1, wherein said control commands contain a command to designate a directory in said second data storage device in said data receiving apparatus for storing contents data received.

7. A data sending apparatus as claimed in claim 1, wherein said control command generator generates said control commands in the MIDI protocol by first generating control commands in a non-MIDI protocol and next converting said non-MIDI control commands to control commands in the MIDI protocol.

8. A data receiving apparatus comprising:

a data storage device for storing contents data in a non-MIDI protocol;

a MIDI interface for receiving data according to the MIDI protocol from a sending apparatus, said received data containing contents data for being stored in said data storage device and control commands for controlling data storing operations of said data storage device;

a from-MIDI data converter which converts the contents data in said received data in the MIDI protocol to contents data in said non-MIDI protocol; and a storage control device which controls data storing operations of said storage device to store said converted contents data in the non-MIDI protocol based on the control commands in said received data in the MIDI protocol.

9. A data receiving apparatus as claimed in claim 8, wherein said control commands contain a command to designate a directory in said storage device, and said storage control device controls to store said converted contents data into said designated directory.

10. A data receiving apparatus as claimed in claim 8, wherein said storage control device includes a from-MIDI command converter which converts the control commands in the MIDI protocol to control commands in a non-MIDI protocol, and then controls said data storing operations based on said control commands in the non-MIDI protocol.

11. A data communication system including:

a data sending apparatus comprising a first data storage device which stores contents data in a non-MIDI protocol; and a data receiving apparatus comprising a second data storage device for storing contents data in a non-MIDI protocol;

said data sending apparatus further comprising:

a MIDI-out interface for sending out data according to the MIDI protocol to said receiving apparatus;

a data read-out device which reads out said contents data from said first data storage device;

a to-MIDI data converter which converts said read-out contents data in the non-MIDI protocol to data in the MIDI protocol;

a data output device which outputs said converted data in the MIDI protocol through said MIDI interface for sending out;

a control command generator which generates control commands in the MIDI protocol for controlling data storing operations of said second data storage device in said receiving apparatus; and a command output device which outputs said control commands in the MIDI protocol through said MIDI interface for sending out; and said data receiving apparatus further comprising:

a MIDI-in interface for receiving data according to the MIDI protocol from said sending apparatus, said received data containing contents data for being stored in said second storage device and control commands for controlling data storing operations of said second data storage device;

a from-MIDI data converter which converts the contents data in said received data in the MIDI protocol to contents data in said non-MIDI protocol; and a storage control device which controls data storing operations of said second storage device to store said converted contents data in the non-MIDI protocol based on the control commands in said received data in the MIDI protocol.

12. A data communication system as claimed in claim 11, wherein said control commands sent out from said data sending apparatus contain a command to detect availability of said second storage device in said data receiving apparatus.

13. A data communication system as claimed in claim 12, wherein said data receiving apparatus further comprises:

a responding device which delivers availability data representing availability of said second storage device in the MIDI protocol in response to said command to detect as received from said data sending apparatus; and a MIDI-out interface for sending out said availability data to said data sending apparatus.

14. A data communication system as claimed in claim 13, wherein said data sending apparatus receives said availability data and further comprises:

a display device which displays the availability of said second storage device as represented said received availability data.

15. A data communication system as claimed in claim 14, wherein said sending apparatus is adapted for designating a data storing area in said second data storage device with reference to said displayed availability.

16. A data communication system as claimed in claim 11, wherein said control commands sent out from said data sending apparatus contain a command to request information about directories or files in said second data storage device available in said data receiving apparatus.

17. A data communication system as claimed in claim 16, wherein said data receiving apparatus further comprises:

a responding device which delivers directory data in the MIDI protocol representing information about directories or files in said second data storage device available in said data receiving apparatus in response to said command to request as received from said data sending apparatus; and a MIDI-out interface for sending out said directory data to said data sending apparatus.

18. A data communication system as claimed in claim 17, wherein said data sending apparatus receives said directory data and further comprises:

a display device which displays the directories or files in said second data storage device as represented said received directory data.

19. A data communication system as claimed in claim 18, wherein said sending apparatus is adapted for designating a directory in said second data storage device with reference to said displayed directories or files.

20. A data communication system as claimed in claim 11, wherein said control commands sent out from said data sending apparatus contain a command to request information about a free space in said second data storage device available in said data receiving apparatus.

21. A data communication system as claimed in claim 20, wherein said data receiving apparatus further comprises:

a responding device which delivers free space data in the MIDI protocol representing information about the free space in said second data storage device available in said data receiving apparatus in response to said command to request as received from said data sending apparatus; and a MIDI-out interface for sending out said free space data to said data sending apparatus.

22. A data communication system as claimed in claim 11, wherein said control commands sent out from said data sending apparatus contain a command to designate a directory in said second data storage device in said data receiving apparatus for storing contents data received.

23. A data communication system as claimed in claim 22, wherein said storage control device controls to store said converted contents data into said designated directory.

24. A data communication system as claimed in claim 11, wherein said control command generator generates said control commands in the MIDI protocol by first generating control commands in a non-MIDI protocol and next converting said non-MIDI control commands to control commands in the MIDI protocol.

25. A data communication system as claimed in claim 11, wherein said storage control device includes a from-MIDI command converter which converts the control commands in the MIDI protocol to control commands in a non-MIDI protocol, and then controls said data storing operations based on said control commands in the non-MIDI protocol.

26. A storage medium for use in an apparatus for sending data to an apparatus for receiving data, said apparatus for sending including a first data storage device which stores contents data in a non-MIDI protocol and a MIDI interface for sending out data according to the MIDI protocol, said apparatus for receiving including a second storage device, both said apparatuses being of a data processing type comprising a computer, said medium containing a program that is executable by the computer, the program comprising:

a module for reading out said contents data from said first data storage device;

a module for converting said read-out contents data in the non-MIDI protocol to data in the MIDI protocol;

a module for outputting said converted contents data in the MIDI protocol through said MIDI interface for sending out;

a module for generating control commands in the MIDI protocol for controlling data storing operations of said second data storage device in said data receiving apparatus; and a module for outputting said control commands in the MIDI protocol through said MIDI interface for sending out.

27. A storage medium for use in an apparatus for receiving data from an apparatus for sending data, said apparatus for receiving including a data storage device for storing contents data in a non-MIDI protocol and a MIDI interface for receiving data according to the MIDI protocol from said sending apparatus, both said apparatuses being of a data processing type comprising a computer, said medium containing a program that is executable by the computer, the program comprising:

a module for recognizing the received data, said received data containing contents data for being stored in said data storage device and control commands for controlling data storing operations of said data storage device, a module for converting the contents data in said received data in the MIDI protocol to contents data in said non-MIDI protocol; and a module for controlling data storing operations of said storage device to said convert ed contents data in the non-MIDI protocol based on the control commands in said received data in the MIDI protocol.

28. A storage medium for use in a data communication system, said system comprising a data sending apparatus including a first data storage device which stores contents data in a non-MIDI protocol and a MIDI-out interface for sending out data according to the MIDI protocol, and a data receiving apparatus including a second data storage device for storing contents data in a non-MIDI protocol and a MIDI-in interface for receiving data according to the MIDI protocol from said sending apparatus, both said apparatuses being of a data processing type comprising a computer, said medium containing a program that is executable by the computer, the program comprising:

a module for reading out said contents data from said first data storage device;

a module for converting said read-out contents data in the non-MIDI protocol to data in the MIDI protocol;

a module for outputting said converted data in the MIDI protocol through said MIDI interface for sending out;

a module for generating control commands in the MIDI protocol for controlling data storing operations of said second data storage device in said receiving apparatus;

a module for outputting said control commands in the MIDI protocol through said MIDI interface for sending out;

a module for recognizing the received data, said received data containing contents data for being stored in said second data storage device and control commands for controlling data storing operations of said second data storage device, a module for converting the contents data in said received data in the MIDI protocol to contents data in the non-MIDI protocol; and a module for controlling data storing operations of said second storage device to store said converted contents data in the non-MIDI protocol based on the control commands in said received data in the MIDI protocol.

29. A method for sending data from a data sending apparatus including a first data storage device which stores contents data in a non-MIDI protocol to a data receiving apparatus including a second data storage device, said method comprising:

a step of reading out said contents data from said first data storage device;

a step of converting said read-out contents data in the non-MIDI protocol to data in the MIDI protocol;

a step of outputting said converted contents data in the MIDI protocol through a MIDI interface for sending out;

a step of generating control commands in the MIDI protocol for controlling data storing operations of said second data storage device in said data receiving apparatus; and a step of outputting said control commands in the MIDI protocol through the MIDI interface for sending out.

30. A method for storing data in a data receiving apparatus connected to a data sending apparatus, said data receiving apparatus including a data storage device for storing contents data in a non-MIDI protocol, said method comprising:

a step of receiving data according to the MIDI protocol from a sending apparatus, said received data containing contents data for being stored in said data storage device and control commands for controlling data storing operations of said data storage device;

a step of converting the contents data in said received data in the MIDI protocol to contents data in said non-MIDI protocol; and a step of controlling data storing operations of said storage device to store said converted contents data in the non-MIDI protocol based on the control commands in said received data in the MIDI protocol.

31. A method for transferring data from a data sending apparatus including a first data storage device which stores contents data in a non-MIDI protocol to a data receiving apparatus including a second data storage device for storing contents data in a non-MIDI protocol, said method comprising:

a step of reading out said contents data from said first data storage device;

a step of converting said read-out contents data in the non-MIDI protocol to data in the MIDI protocol;

a step of outputting said converted contents data in the MIDI protocol through a MIDI interface for sending out;

a step of generating control commands in the MIDI protocol for controlling data storing operations of said second data storage device in said data receiving apparatus;

a step of outputting said control commands in the MIDI protocol through the MIDI interface for sending out;

a step of receiving said contents data in the MIDI protocol and said control command in the MIDI protocol from said sending apparatus;

a step of converting said received contents data in the MIDI protocol to contents data in the non-MIDI protocol; and a step of controlling data storing operations of said second storage device to store said converted contents data in the non-MIDI protocol based on said received control commands.

* * * * *

UNITED STATES PATENT AND TRADEMARK OFFICE

CERTIFICATE OF CORRECTION

PATENT NO. : 6,232,541 B1
DATED : May 15, 2001
INVENTOR(S) : Tomoyuki Kumagai

It is certified that error appears in the above-identified patent and that said Letters Patent is hereby corrected as shown below:

Figure 6,
Block 204: please delete "Exclutive" and insert -- Exclusive --.

Signed and Sealed this

Nineteenth Day of March, 2002

*Attest:*

*Attesting Officer*

JAMES E. ROGAN
*Director of the United States Patent and Trademark Office*